US012286208B2

(12) United States Patent
Tsuchiya

(10) Patent No.: US 12,286,208 B2
(45) Date of Patent: Apr. 29, 2025

(54) MARINE VESSEL MANEUVERING SYSTEM AND MARINE VESSEL

(71) Applicant: YAMAHA HATSUDOKI KABUSHIKI KAISHA, Iwata (JP)

(72) Inventor: Toshiya Tsuchiya, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 572 days.

(21) Appl. No.: 17/539,323

(22) Filed: Dec. 1, 2021

(65) Prior Publication Data

US 2022/0169357 A1 Jun. 2, 2022

(30) Foreign Application Priority Data

Dec. 2, 2020 (JP) ..... 2020-200441

(51) Int. Cl.
*B63H 25/42* (2006.01)
*B63B 79/40* (2020.01)
*B63H 25/02* (2006.01)

(52) U.S. Cl.
CPC ..... *B63H 25/42* (2013.01); *B63B 79/40* (2020.01); *B63H 25/02* (2013.01); *B63H 2025/028* (2013.01)

(58) Field of Classification Search
CPC .. B63H 25/42; B63H 25/02; B63H 2025/028; B63H 21/213; B63H 2025/026; B63B 79/40
See application file for complete search history.

(56) References Cited

U.S. PATENT DOCUMENTS

| | | | | |
|---|---|---|---|---|
| 6,230,642 | B1 * | 5/2001 | McKenney | G05G 9/047 114/144 R |
| 11,208,181 | B1 * | 12/2021 | Beall | F21V 7/0033 |
| 2004/0029461 | A1 | 2/2004 | Shomura | |
| 2015/0089427 | A1 * | 3/2015 | Akuzawa | G05D 1/0206 715/771 |
| 2019/0084662 | A1 * | 3/2019 | Wong | B63H 25/04 |
| 2021/0163114 | A1 * | 6/2021 | Bondesson | B63H 25/02 |

FOREIGN PATENT DOCUMENTS

JP 2004-068704 A 3/2004

* cited by examiner

*Primary Examiner* — Yufeng Zhang
(74) *Attorney, Agent, or Firm* — Keating & Bennett, LLP

(57) ABSTRACT

A marine vessel maneuvering system includes an operator to receive both a propulsive force operation to change a propulsive force of a propulsion device and a steering operation to turn the propulsion device to steer a marine vessel, and a controller configured or programmed to perform a control to automatically drive the propulsion device to move the marine vessel in an automatic marine vessel maneuvering mode. The controller is configured or programmed to perform a control to transition to the automatic marine vessel maneuvering mode based on a transition operation being performed on the operator.

20 Claims, 5 Drawing Sheets

MARINE VESSEL MANEUVERING SYSTEM AND MARINE VESSEL

CROSS REFERENCE TO RELATED APPLICATIONS

This application claims the benefit of priority to Japanese Patent Application No. 2020-200441 filed on Dec. 2, 2020. The entire contents of this application are hereby incorporated herein by reference.

BACKGROUND OF THE INVENTION

1. Field of the Invention

The present invention relates to a marine vessel maneuvering system to maneuver a marine vessel and a marine vessel.

2. Description of the Related Art

A marine vessel maneuvering system to maneuver a marine vessel and a marine vessel are known in general. Such a marine vessel maneuvering system and a marine vessel are disclosed in Japanese Patent Laid-Open No. 2004-068704, for example.

Japanese Patent Laid-Open No. 2004-068704 discloses a marine vessel including a control device to maneuver the marine vessel in a control mode in which the rotation speed of an engine is adjustable. The marine vessel includes a remote control box including an UP button and a DOWN button to increase and decrease the rotation speed in the control mode. In addition to the UP button and the DOWN button, the remote control box includes a lever operator to receive an operation to switch a throttle opening degree and a shift state.

Although not clearly described in Japanese Patent Laid-Open No. 2004-068704, in an outboard motor as described in Japanese Patent Laid-Open No. 2004-068704, a DOWN button on the remote control box is pressed such that transition to the control mode in which the rotation speed of the engine is adjustable is performed. Furthermore, a dedicated transition button provided on an operation panel may also be pressed such that transition to the control mode is performed. When an outboard motor described in Japanese Patent Laid-Open No. 2004-068704 is configured in this manner, it is necessary to first press the DOWN button when transition to the control mode is performed, but a vessel user may have an intention to increase the rotation speed in the control mode before transition to the control mode. In such a case, it is necessary to first press the DOWN button in order to perform transition to the control mode, but the vessel user may intuitively press an UP button from the beginning with the intention of increasing the rotation speed. Therefore, the ease of (operability for) a transition operation to the control mode is decreased. When transition to the control mode is performed through the operation panel, the vessel user needs to stretch his or her hand to the operation panel when the operation panel is located at a relatively distant position. Also in such a case, the ease of (operability for) the transition operation to the control mode is decreased. In consideration of the above, it has been conventionally required to improve the operability for the transition operation to the control mode.

SUMMARY OF THE INVENTION

Preferred embodiments of the present invention provide marine vessel maneuvering systems and marine vessels that each improve operability for transition operations to automatic marine vessel maneuvering modes.

A marine vessel maneuvering system according to a preferred embodiment of the present invention includes an operator to receive both a propulsive force operation to change a propulsive force of a propulsion device and a steering operation to turn the propulsion device to steer a marine vessel, and a controller configured or programmed to perform a control to automatically drive the propulsion device to move the marine vessel in an automatic marine vessel maneuvering mode, and perform a control to transition to the automatic marine vessel maneuvering mode based on a transition operation being performed on the operator.

A marine vessel maneuvering system according to a preferred embodiment of the present invention includes the operator to receive both the propulsive force operation and the steering operation from a vessel user, and the controller configured or programmed to perform a control to automatically drive the propulsion device to move the marine vessel in the automatic marine vessel maneuvering mode. The controller is configured or programmed to perform a control to transition to the automatic marine vessel maneuvering mode based on the transition operation being performed on the operator. Accordingly, the transition operation is performed on the operator that allows the propulsive force operation and the steering operation to be performed. That is, the propulsive force operation, the steering operation, and the transition operation are performed through the common device (operator). Therefore, when the transition operation is to be performed while the operator is operated, the vessel user does not need to stretch his or her hand to an operation panel unlike in the conventional case. Furthermore, the transition operation is performed on the operator itself, and thus the need to perform the transition operation on a DOWN button to set a rotation speed is eliminated unlike in the conventional case. Consequently, a decrease in the ease of (operability for) the transition operation to the automatic marine vessel maneuvering mode is significantly reduced or prevented. Thus, the operability for the transition operation to the automatic marine vessel maneuvering mode is improved.

In a marine vessel maneuvering system according to a preferred embodiment of the present invention, the controller is preferably configured or programmed to discriminate between the automatic marine vessel maneuvering mode and an operator mode in which the operator receives the propulsive force operation and the steering operation from the vessel user, and perform a control to transition to the automatic marine vessel maneuvering mode with the operator mode being canceled. Accordingly, the transition to the automatic marine vessel maneuvering mode is performed after the operator mode is reliably canceled.

In such a case, a marine vessel maneuvering system according to a preferred embodiment of the present invention preferably further includes a remote control lever to switch a neutral state, a forward movement state, and a reverse movement state of the propulsion device, the propulsion device preferably includes a plurality of propulsion devices, and the controller is preferably configured or programmed to perform a control to transition to the automatic marine vessel maneuvering mode based on the operator mode being canceled and the plurality of propulsion devices operated by the remote control lever being switched to the same forward movement state or the same reverse movement state. Accordingly, the transition to the automatic marine vessel maneuvering mode is performed after the operator mode is reliably canceled and the plurality of propulsion devices operated by the remote control lever are reliably switched to the same forward movement state or the same reverse movement state.

In a marine vessel maneuvering system according to a preferred embodiment of the present invention, the operator preferably includes a joystick including a stick gripped and operated by the vessel user and a stick support to support the stick, and the controller is preferably configured or programmed to perform a control to transition to the automatic marine vessel maneuvering mode based on the transition operation including at least one of tilting the stick or twisting the stick being performed. Accordingly, the transition operation on the joystick is performed by at least one of tilting the stick or twisting the stick, and thus the transition operation is intuitively performed. Thus, the operability for the transition operation to the automatic marine vessel maneuvering mode is further improved.

In a marine vessel maneuvering system according to a preferred embodiment of the present invention, the automatic marine vessel maneuvering mode preferably includes at least one of a speed control mode to adjust a rotation speed of a drive of the propulsion device or a speed of the marine vessel, a target orientation holding mode to hold a target orientation of the marine vessel, or a target course holding mode to hold a linear target course of the marine vessel. Accordingly, the operability for the transition operation to at least one of the speed control mode, the target orientation holding mode, or the target course holding mode is improved.

In such a case, the operator preferably includes a joystick including a stick and a stick support, and the controller is preferably configured or programmed to perform a control to transition to the speed control mode based on the transition operation of tilting the stick in a forward-rearward direction being performed when the automatic marine vessel maneuvering mode includes the speed control mode. Accordingly, the transition operation to the speed control mode is performed by tilting the stick in the forward-rearward direction in which the marine vessel moves, and thus the transition operation is intuitively performed. Thus, the operability for the transition operation to the speed control mode is further improved.

In a marine vessel maneuvering system including the operator that includes the joystick, the controller is preferably configured or programmed to perform a control to adjust a speed set value indicating the rotation speed of the drive or the speed of the marine vessel based on an adjustment operation of tilting the stick in the forward-rearward direction being performed after the transition to the speed control mode. Accordingly, the transition operation to the speed control mode and the adjustment operation in the speed control mode are performed by a similar operation method. That is, after the transition operation to the speed control mode, the adjustment operation in the speed control mode is subsequently performed by a similar operation. Consequently, the vessel user easily obtains an operation method for the adjustment operation, and thus the operability for the transition operation to the speed control mode is still further improved.

In a marine vessel maneuvering system that adjusts the speed set value based on the adjustment operation of tilting the stick in the forward-rearward direction being performed, the controller is preferably configured or programmed to, after the transition to the speed control mode, perform a control to increase the speed set value based on the adjustment operation of tilting the stick forward being performed, and perform a control to decrease the speed set value based on the adjustment operation of tilting the stick rearward being performed. Accordingly, the vessel user tilts the stick forward according to the vessel user's feeling of wanting to move forward faster such that the controller increases the speed set value. Furthermore, the vessel user tilts the stick rearward according to the vessel user's feeling of wanting to move forward slower such that the controller decreases the speed set value. Therefore, the adjustment operation is more intuitively performed. Thus, the operability for the transition operation to the speed control mode is still further improved.

In a marine vessel maneuvering system in which the automatic marine vessel maneuvering mode includes at least one of the speed control mode, the target orientation holding mode, or the target course holding mode, the operator preferably includes a joystick including a stick and a stick support, and the controller is preferably configured or programmed to perform a control to transition to the target orientation holding mode based on the transition operation of twisting the stick being performed when the automatic marine vessel maneuvering mode includes the target orientation holding mode. Accordingly, the transition operation to the target orientation holding mode is performed by twisting (rotating) the stick in a rotation direction in which the marine vessel is steered. Therefore, the operability for the transition operation to the target orientation holding mode is further improved.

In such a case, the controller is preferably configured or programmed to perform a control to adjust an orientation set value indicating the target orientation based on an adjustment operation of twisting the stick being performed after the transition to the target orientation holding mode. Accordingly, the transition operation to the target orientation holding mode and the adjustment operation in the target orientation holding mode are performed by a similar operation method. That is, after the transition operation to the target orientation holding mode, the adjustment operation in the target orientation holding mode is subsequently performed by a similar operation. Consequently, the vessel user easily obtains an operation method for the adjustment operation, and thus the operability for the transition operation to the target orientation holding mode is still further improved.

In a marine vessel maneuvering system in which the automatic marine vessel maneuvering mode includes at least one of the speed control mode, the target orientation holding mode, or the target course holding mode, the operator preferably includes a joystick including a stick and a stick support, and the controller is preferably configured or programmed to perform a control to transition to the target course holding mode based on the transition operation of tilting the stick in a right-left direction being performed when the automatic marine vessel maneuvering mode includes the target course holding mode. Accordingly, the transition operation to the target course holding mode is performed by a simple operation of tilting the stick in the right-left direction, and thus the operability for the transition operation to the target course holding mode is further improved.

In such a case, the controller is preferably configured or programmed to perform a control to adjust a course set value indicating a position of the linear target course based on an adjustment operation of tilting the stick in the right-left direction being performed after the transition to the target course holding mode. Accordingly, the transition operation to the target course holding mode and the adjustment operation in the target course holding mode are performed by a similar operation method. That is, after the transition operation to the target course holding mode, the adjustment operation in the target course holding mode is subsequently performed by a similar operation. Consequently, the vessel user easily obtains an operation method for the adjustment operation, and thus the operability for the transition operation to the target course holding mode is still further improved.

In a marine vessel maneuvering system including the controller configured or programmed to perform a control to transition to the automatic marine vessel maneuvering mode based on the operator mode being canceled and the plurality of propulsion devices being switched to the same forward movement state or the same reverse movement state, the controller is preferably configured or programmed to perform a control to cancel the operator mode based on the plurality of propulsion devices operated by the remote control lever being switched from the neutral state to the same forward movement state or the same reverse movement state. Accordingly, the operator mode is canceled based on the plurality of propulsion devices operated by the remote control lever being switched from the neutral state to the same forward movement state or the same reverse movement state before the transition operation to the automatic marine vessel maneuvering mode is performed. Therefore, a shift switching operation also functions as an operation to cancel the operator mode, and thus operability in the preparatory stages before the transition operation is improved.

A marine vessel maneuvering system according to a preferred embodiment of the present invention preferably further includes a notifier to notify the vessel user of the transition to the automatic marine vessel maneuvering mode. Accordingly, the vessel user reliably recognizes that the transition to the automatic marine vessel maneuvering mode has been performed by the transition operation through the notifier.

A marine vessel according to a preferred embodiment of the present invention includes a hull, a propulsion device attached to the hull, and a marine vessel maneuvering system. The marine vessel maneuvering system include an operator to receive both a propulsive force operation to change a propulsive force of the propulsion device and a steering operation to turn the propulsion device to steer the hull, and a controller configured or programmed to perform a control to automatically drive the propulsion device to move the hull in an automatic marine vessel maneuvering mode. The controller is configured or programmed to perform a control to transition to the automatic marine vessel maneuvering mode based on a transition operation being performed on the operator.

A marine vessel according to a preferred embodiment of the present invention includes the operator to receive both the propulsive force operation and the steering operation from a vessel user, and the controller configured or programmed to automatically drive the propulsion device to move the hull in the automatic marine vessel maneuvering mode. The controller is configured or programmed to perform a control to transition to the automatic marine vessel maneuvering mode based on the transition operation being performed on the operator. Accordingly, the transition operation is performed on the operator that allows the propulsive force operation and the steering operation to be performed. That is, the propulsive force operation, the steering operation, and the transition operation are performed through the common device (operator). Therefore, when the transition operation is to be performed while the operator is operated, the vessel user does not need to stretch his or her hand to an operation panel unlike in the conventional case. Furthermore, the transition operation is performed on the operator itself, and thus the need to perform the transition operation on a DOWN button to set a rotation speed of a drive of the propulsion device is eliminated unlike in the conventional case. Consequently, a decrease in the ease of (operability for) the transition operation to the automatic marine vessel maneuvering mode is significantly reduced or prevented. Thus, the operability for the transition operation to the automatic marine vessel maneuvering mode is improved.

In a marine vessel according to a preferred embodiment of the present invention, the controller is preferably configured or programmed to discriminate between the automatic marine vessel maneuvering mode and an operator mode in which the operator receives the propulsive force operation and the steering operation from the vessel user, and perform a control to transition to the automatic marine vessel maneuvering mode with the operator mode being canceled. Accordingly, the transition to the automatic marine vessel maneuvering mode is performed after the operator mode is reliably canceled.

In such a case, the marine vessel maneuvering system preferably further includes a remote control lever to switch a neutral state, a forward movement state, and a reverse movement state of the propulsion device, the propulsion device preferably includes a plurality of propulsion devices, and the controller is preferably configured or programmed to perform a control to transition to the automatic marine vessel maneuvering mode based on the operator mode being canceled and the plurality of propulsion devices operated by the remote control lever being switched to the same forward movement state or the same reverse movement state. Accordingly, the transition to the automatic marine vessel maneuvering mode is performed after the operator mode is reliably canceled and the plurality of propulsion devices operated by the remote control lever are reliably switched to the same forward movement state or the same reverse movement state.

In a marine vessel according to a preferred embodiment of the present invention, the operator preferably includes a joystick including a stick gripped and operated by the vessel user and a stick support to support the stick, and the controller is preferably configured or programmed to perform a control to transition to the automatic marine vessel maneuvering mode based on the transition operation including at least one of tilting the stick or twisting the stick being performed. Accordingly, the transition operation on the joystick is performed by at least one of tilting the stick or twisting the stick, and thus the transition operation is intuitively performed. Thus, the operability for the transition operation to the automatic marine vessel maneuvering mode is further improved.

In a marine vessel according to a preferred embodiment of the present invention, the automatic marine vessel maneuvering mode preferably includes at least one of a speed control mode to adjust a rotation speed of the drive of the propulsion device or a speed of the hull, a target orientation holding mode to hold a target orientation of the hull, or a target course holding mode to hold a linear target course of the hull. Accordingly, the operability for the transition operation to at least one of the speed control mode, the target orientation holding mode, or the target course holding mode is improved.

In such a case, the operator preferably includes a joystick including a stick and a stick support, and the controller is preferably configured or programmed to perform a control to transition to the speed control mode based on the transition operation of tilting the stick in a forward-rearward direction being performed when the automatic marine vessel maneuvering mode includes the speed control mode. Accordingly, the transition operation to the speed control mode is performed by tilting the stick in the forward-rearward direction in which the hull moves, and thus the transition operation is intuitively performed. Thus, the operability for the transition operation to the speed control mode is further improved.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

The structure of a marine vessel 100 including a marine vessel maneuvering system 100*c* according to preferred embodiments of the present invention is now described with reference to FIGS. 1 to 9. In the figures, arrow FWD represents the forward movement direction of the marine vessel 100 (front side with reference to a hull 100*a*), and arrow BWD represents the reverse movement direction of the marine vessel 100 (rear side with reference to the hull 100*a*).

Figure 1:
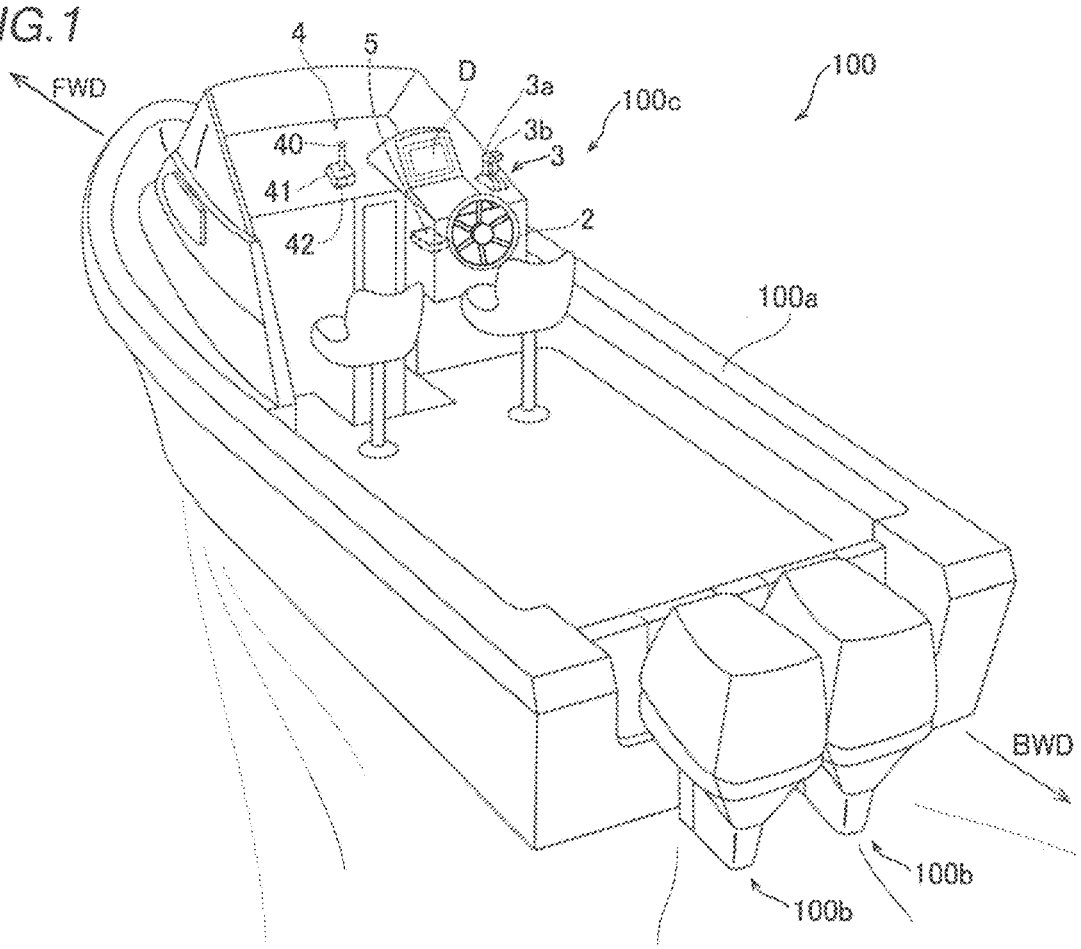
FIG. 1 is a perspective view schematically showing a marine vessel including an outboard motor and a marine vessel maneuvering system according to a preferred embodiment of the present invention.

As shown in FIG. 1, the marine vessel 100 includes the hull 100*a*, a plurality of (two) outboard motors 100*b*, and the marine vessel maneuvering system 100*c*. The outboard motors 100*b* are examples of a "propulsion device".

The plurality of outboard motors 100*b* are attached to a transom of the hull 100*a*. That is, the marine vessel 100 is an outboard motor boat including the plurality of outboard motors 100*b*.

Figure 2:
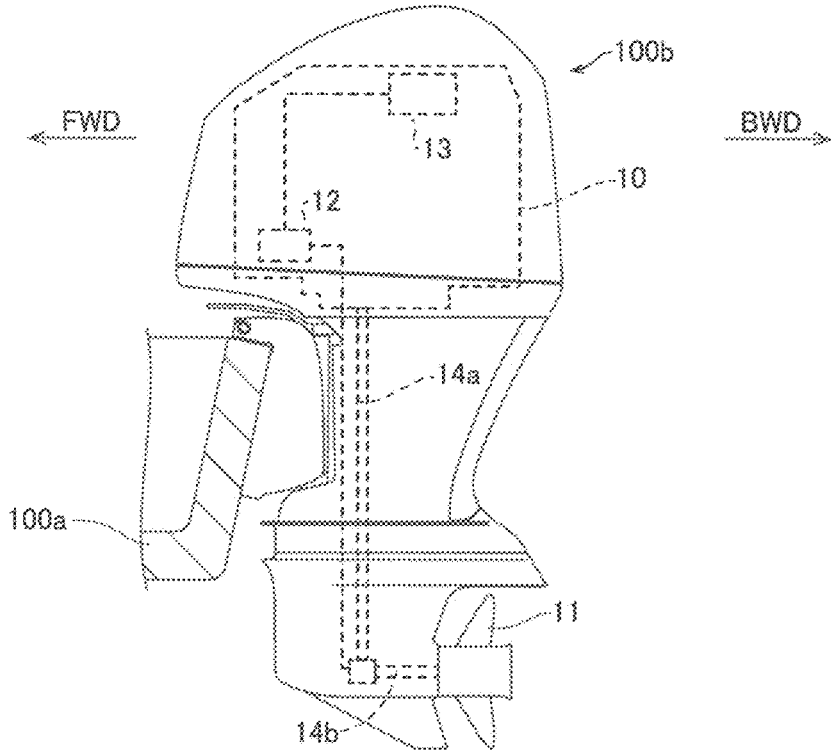
FIG. 2 is a side view illustrating the structure of an outboard motor according to a preferred embodiment of the present invention.

As shown in FIG. 2, each of the outboard motors 100*b* includes an engine 10, a propeller 11, a shift actuator 12, and an engine control unit (ECU) 13. The engine 10 is an example of a "drive".

The engine 10 is, for example, an internal combustion engine, and generates a driving force by burning fuel and rotating a crankshaft (not shown). The engine 10 rotates the propeller 11 by the generated driving force.

The shift actuator 12 switches the shift state of the outboard motor 100*b* to one of a forward movement state (F), a neutral state (N), and a reverse movement state (R) based on an operation to switch a remote control lever 3 of the marine vessel maneuvering system 100*c*, which is described below, to one of a forward movement position FP, a neutral position NP, and a reverse movement position RP (see FIG. 4).

The "shift state" described above refers to a state in which a driving force is transmitted from a drive shaft 14*a* to a propeller shaft 14*b*. In the forward movement state (F) the propeller 11 rotates in a predetermined direction to move the hull 100*a* forward, in the reverse movement state (R) the propeller 11 rotates in a direction opposite to the predetermined direction to move the hull 100*a* rearward, and in the neutral state (N) the propeller 11 does not rotate.

The ECU 13 is a control circuit including a central processing unit (CPU) and a memory. The ECU 13 controls driving of the engine 10 and driving of the shift actuator 12 based on a command from the marine vessel maneuvering system 100*c*. The ECU 13 performs various drive control processes by executing programs stored in the memory.

Figure 3:
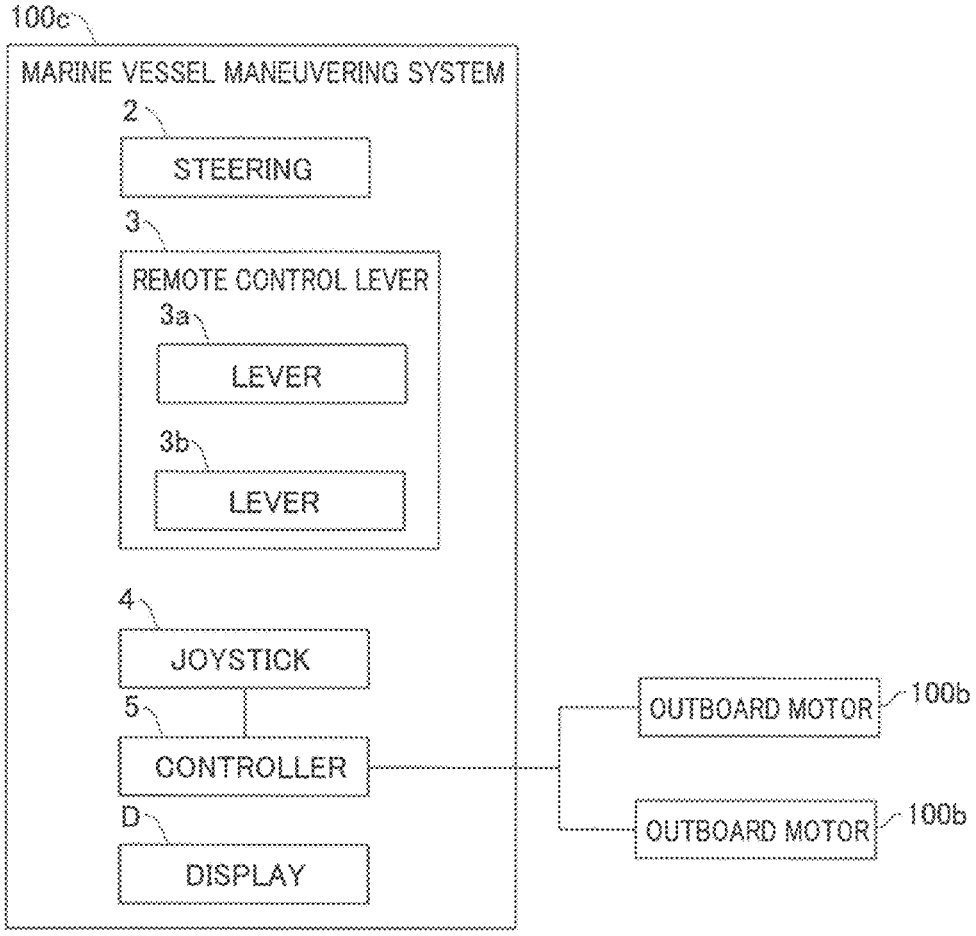
FIG. 3 is a block diagram showing the structure of a marine vessel maneuvering system and an outboard motor according to a preferred embodiment of the present invention.

As shown in FIG. 3, the marine vessel maneuvering system 100*c* maneuvers the marine vessel 100 (see FIG. 1). That is, the marine vessel maneuvering system 100*c* controls driving of the plurality of outboard motors 100*b* based on a vessel user's operation on various operators.

The marine vessel maneuvering mode of the marine vessel 100 by the marine vessel maneuvering system 100*c* includes an "automatic marine vessel maneuvering mode" in which the outboard motors 100*b* are automatically driven to move the marine vessel 100.

The marine vessel maneuvering mode of the marine vessel 100 by the marine vessel maneuvering system 100*c* includes a "joystick mode" in which the marine vessel 100 is maneuvered by a joystick 4 in a state other than the automatic marine vessel maneuvering mode. In the following description, a marine vessel maneuvering mode other than the automatic marine vessel maneuvering mode and the joystick mode is referred to as a "normal marine vessel maneuvering mode". The joystick 4 is an example of an "operator". The joystick mode is an example of an "operator mode".

The automatic marine vessel maneuvering mode includes three types of modes including a "speed control mode", a "target orientation holding mode (heading hold)", and a "target course holding mode (course hold)".

The speed control mode is a marine vessel maneuvering mode in which the rotation speeds of the engines 10 of the outboard motors 100*b* or the speed of the marine vessel 100 is maintained constant. In the speed control mode, a control is performed to adjust a speed set value indicating the rotation speed of the engine 10 based on a predetermined adjustment operation being performed by the vessel user.

The marine vessel maneuvering system 100*c* adjusts the rotation speed of the engine 10 by the remote control lever 3 in the normal marine vessel maneuvering mode, but more finely adjusts (fine-tunes) the rotation speed of the engine 10 as compared with adjustment by the remote control lever 3 in the speed control mode.

The target orientation holding mode is a marine vessel maneuvering mode to hold the target orientation TD (FIG. 7) of the marine vessel 100 (see FIG. 1). In the target orientation holding mode, when the marine vessel 100 drifts due to wind or waves, for example, a point located ahead in the target orientation of the marine vessel 100 varies, but the target orientation is maintained unchanged. In the target orientation holding mode, a control is performed to adjust an orientation set value indicating the target orientation based on a predetermined adjustment operation being performed by the vessel user.

The target course holding mode is a marine vessel maneuvering mode to hold the linear target course TC (see FIG. 8) of the marine vessel 100. In the target course holding mode, when the marine vessel 100 drifts due to wind or waves, for example (when the marine vessel 100 deviates from the linear target course TC), a predetermined control is performed to return to the linear target course. In the target course holding mode, a control is performed to adjust a course set value indicating the position of the linear target course TC based on a predetermined adjustment operation being performed by the vessel user.

The marine vessel maneuvering system 100*c* includes a steering 2, the remote control lever 3, the joystick 4, a controller 5, and a display D. The display D is an example of a "notifier".

The steering 2 is an operator to receive a steering operation to turn the outboard motors 100*b* to steer the marine vessel 100. That is, the steering 2 indicates the steering angles of the outboard motors 100*b* to steer the marine vessel 100.

Figure 4:
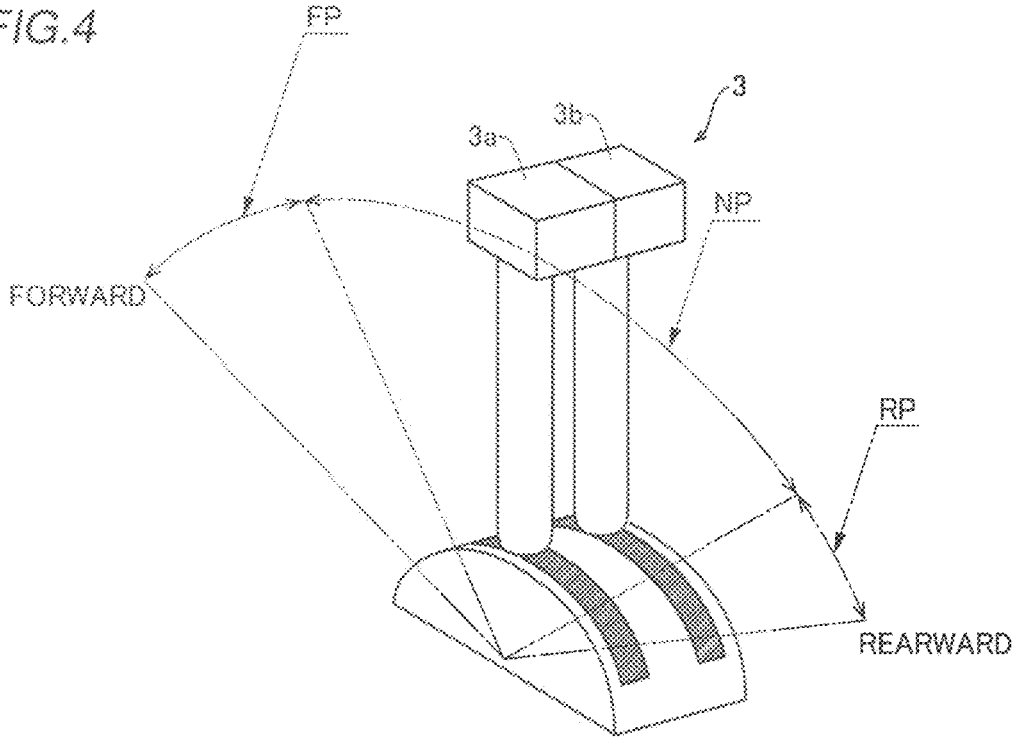
FIG. 4 is a perspective view showing a remote control lever according to a preferred embodiment of the present invention.

As shown in FIG. 4, the remote control lever 3 includes a lever 3*a* to receive an operation on the port outboard motor 100*b* (see FIG. 3) and a lever 3*b* to receive an operation on the starboard outboard motor 100*b*. The levers 3*a* and 3*b* are tiltable in a forward-rearward direction. That is, driving of the port and starboard outboard motors 100*b* is individually operated. A predetermined operation button (not shown) may be pressed such that both the port and starboard outboard motors 100*b* are similarly driven by one of the levers 3*a* and 3*b* of the remote control lever 3.

The remote control lever 3 switches the neutral states, the forward movement states, and the reverse movement states of the outboard motors 100*b*.

Specifically, the lever 3*a* (3*b*) has a range from a position tilted forward by a predetermined angle to a position tilted rearward by a predetermined angle as the neutral position NP to stop the propeller 11. The lever 3*a* (3*b*) has a range further tilted forward from the neutral position NP as the forward movement position FP to move the marine vessel 100 forward. The lever 3*a* (3*b*) has a range further tilted rearward from the neutral position NP as the reverse movement position RP to move the marine vessel 100 rearward.

Therefore, the remote control lever 3 switches the neutral states, the forward movement states, and the reverse movement states of the outboard motors 100*b* by a change in the tilt angle of the lever 3*a* (3*b*).

Figure 5:
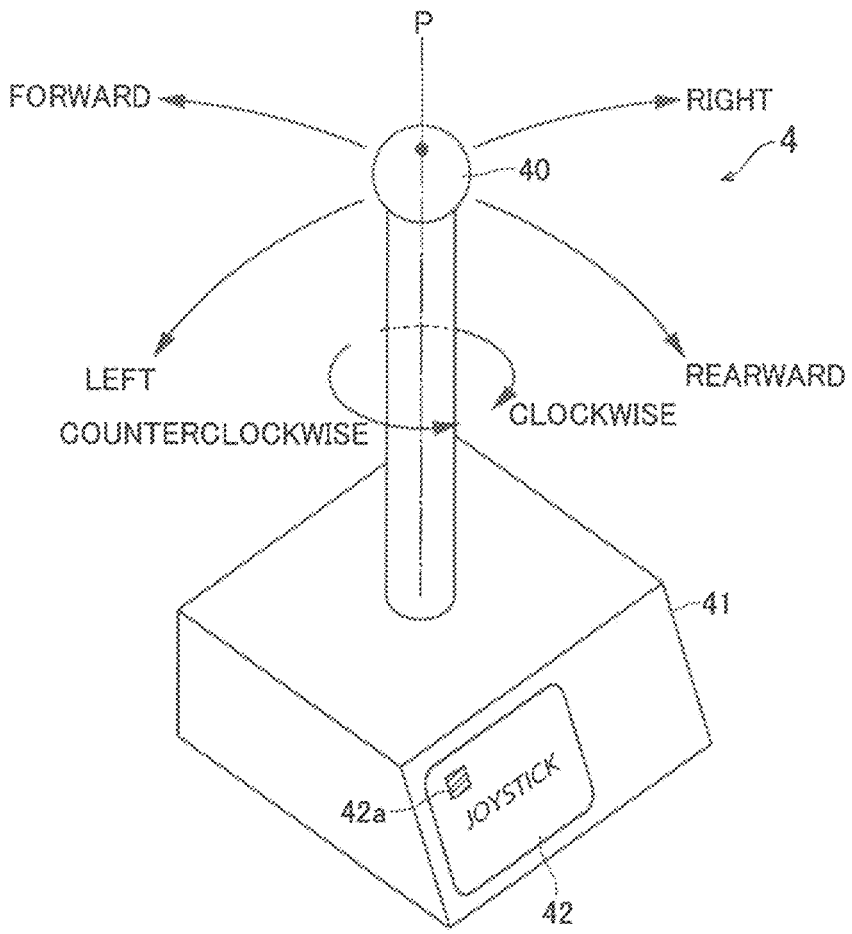
FIG. 5 is a perspective view showing a joystick according to a preferred embodiment of the present invention.

As shown in FIG. 5, the joystick 4 receives both a propulsive force operation to change the propulsive forces of the outboard motors 100*b* (see FIG. 3) and a steering operation to turn the outboard motors 100*b* to steer the marine vessel 100. That is, the joystick 4 generally performs the operation functions of both the steering 2 and the remote control lever 3.

The joystick 4 includes a stick 40 gripped and operated by the vessel user, and a stick support 41 to support the stick 40.

The stick support 41 includes a joystick button 42. When the joystick button 42 is pressed, a control is performed to transition the normal marine vessel maneuvering mode to the joystick mode in which the joystick 4 receives the propulsive force operation and the steering operation from the vessel user. The joystick 4 includes a lamp 42*a* that is continuously lit during the joystick mode to indicate that the joystick mode is in effect.

As a prerequisite for transitioning to the joystick mode, the levers 3*a* and 3*b* of the remote control lever 3 shown in FIG. 4 need to be located at the neutral position. Furthermore, the levers 3*a* and 3*b* of the remote control lever 3 are switched to the same forward movement position FP or the same reverse movement position RP, and all the outboard motors 100*b* are switched to the same forward movement state or the same reverse movement state such that the joystick mode is canceled by the controller 5 (see FIG. 3).

The stick 40 shown in FIG. 5 is tiltable in forward-rearward, right-left, and diagonal directions from a reference position P that extends directly up. The marine vessel maneuvering system 100*c* (see FIG. 3) moves the marine vessel 100 in the tilted direction of the stick 40 while maintaining the direction of the hull 100*a* (see FIG. 1) in the joystick mode. The stick 40 includes an urging member therein, and returns to the reference position P when the vessel user releases the stick 40.

The stick 40 is twistable in a clockwise direction and a counterclockwise direction from the reference position P. The marine vessel maneuvering system 100*c* steers the marine vessel 100 in the twisted direction of the stick 40 in the joystick mode.

The joystick 4 receives a predetermined operation even when the joystick mode is canceled.

Specifically, the joystick 4 receives a transition operation to transition to each of the "speed control mode", the "target orientation holding mode", and the "target course holding mode". Furthermore, the joystick 4 receives an adjustment operation for a predetermined set value in each mode after the transition to each of the above modes.

As a prerequisite for transitioning to each automatic marine vessel maneuvering mode (the speed control mode, the target orientation holding mode, and the target course holding mode), all the outboard motors 100*b* operated by the remote control lever 3 (see FIG. 4) need to be switched to the same forward movement state or the same reverse movement state. That is, the joystick mode needs to be canceled (the outboard motors 100*b* need to be not in the neutral state) as a prerequisite for transitioning to each automatic marine vessel maneuvering mode.

The controller 5 shown in FIG. 1 is a control circuit including a central processing unit (CPU) and a memory.

The controller 5 performs a control to automatically drive the outboard motors 100*b* to move the marine vessel 100 in the automatic marine vessel maneuvering mode. The controller 5 performs a control to transition to the automatic marine vessel maneuvering mode based on the transition operation being performed on the joystick 4.

The controller 5 discriminates between the automatic marine vessel maneuvering mode and the joystick mode in which the joystick 4 receives the propulsive force operation and the steering operation from the vessel user, and performs a control to transition to the automatic marine vessel maneuvering mode with the joystick mode being canceled.

The controller 5 performs a control to transition to the automatic marine vessel maneuvering mode (the speed control mode, the target orientation holding mode, or the target course holding mode) based on the joystick mode being canceled and all the outboard motors 100*b* operated by the remote control lever 3 being switched to the same forward movement state or the same reverse movement state.

The controller 5 performs a control to transition to the automatic marine vessel maneuvering mode based on the transition operation including tilting the stick 40 of the joystick 4 and twisting the stick 40 being performed. The details of the transition operation are described in the following description for each automatic marine vessel maneuvering mode.

The controller 5 shown in FIG. 1 performs a control to transition to the speed control mode based on the transition operation of tilting the stick 40 (see FIG. 5) in the forward-rearward direction being performed.

Specifically, the controller 5 performs a control to transition to the speed control mode based on the transition operation of tilting the stick 40 forward (or rearward) from the reference position P (see FIG. 5) being performed.

The controller 5 performs a control to adjust the speed set value indicating the rotation speed of the engine 10 based on the adjustment operation of tilting the stick 40 in the forward-rearward direction being performed similarly to the transition operation to the speed control mode after the transition to the speed control mode.

Specifically, the controller 5 performs a control to increase the speed set value based on the adjustment operation of tilting the stick 40 forward from the reference position P being performed after the transition to the speed control mode. Consequently, the rotation speed of the engine 10 increases. Furthermore, the controller 5 performs a control to decrease the speed set value based on the adjustment operation of tilting the stick 40 rearward from the reference position P being performed after the transition to the speed control mode. Consequently, the rotation speed of the engine 10 decreases.

At this time, as an example, the controller 5 may increase (decrease) the speed set value in a stepwise manner as the duration of a state in which the stick 40 is tilted forward (rearward) increases.

Figure 6:
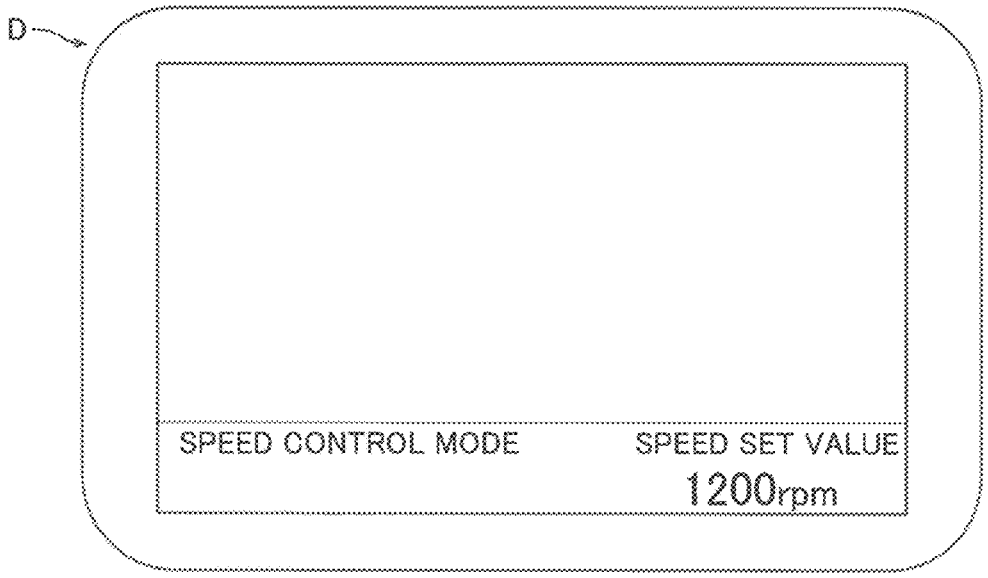
FIG. 6 is a diagram showing a display in a speed control mode according to a preferred embodiment of the present invention.

As shown in FIG. 6, when transition to the speed control mode is performed, the display D notifies the vessel user of the transition to the speed control mode by a predetermined display. The display D includes a touch panel, for example.

As a specific example, when transition to the speed control mode is performed, the display D displays characters "speed control mode" on a display screen. Furthermore, the display D displays a current speed set value (the rotation speed [rpm] of the engine 10) set by the adjustment operation of the vessel user. The display D may display the current actual rotation speed of the engine 10.

The controller 5 shown in FIG. 1 performs a control to transition to the target orientation holding mode based on the transition operation of twisting the stick 40 (see FIG. 5) being performed.

Specifically, the controller 5 performs a control to transition to the target orientation holding mode based on the transition operation of tilting the stick 40 in the clockwise direction (or counterclockwise direction) from the reference position P (see FIG. 5) being performed.

The controller 5 performs a control to adjust the orientation set value indicating the target orientation TD (see FIG. 7) based on the adjustment operation of twisting the stick 40 being performed similarly to the transition operation to the target orientation holding mode after the transition to the target orientation holding mode.

Specifically, the controller 5 performs a control to change the target orientation TD to the starboard side based on the adjustment operation of twisting the stick 40 in the clockwise direction from the reference position P being performed after the transition to the target orientation holding mode. Furthermore, the controller 5 performs a control to change the target orientation TD to the port side based on the adjustment operation of twisting the stick 40 in the counterclockwise direction from the reference position P being performed after the transition to the target orientation holding mode.

At this time, as an example, the controller 5 may direct the target orientation TD farther to the starboard side (farther to the port side) in a stepwise manner as the duration of a state in which the stick 40 is twisted in the clockwise direction (counterclockwise direction) increases.

Figure 7:
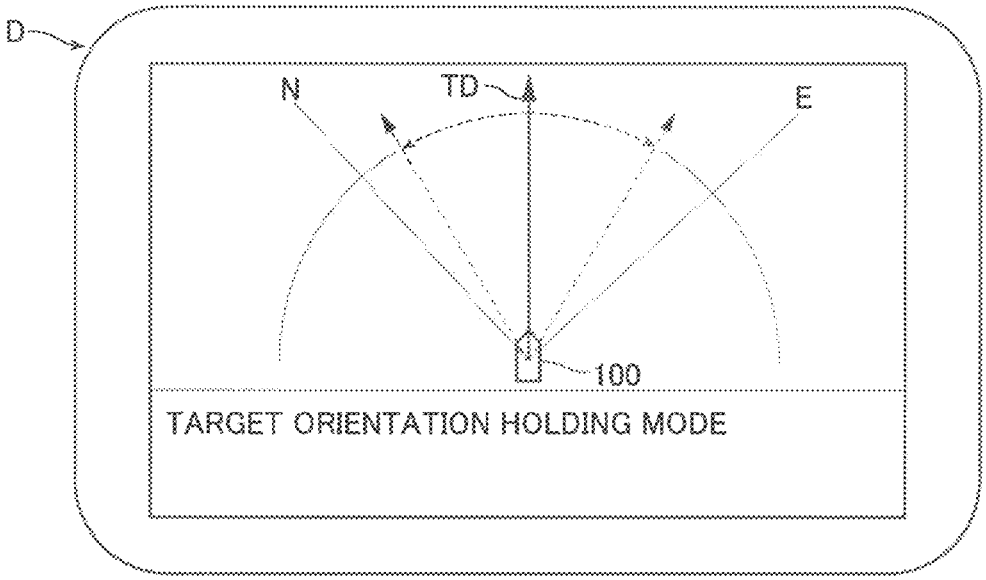
FIG. 7 is a diagram showing a display in a target orientation holding mode according to a preferred embodiment of the present invention.

As shown in FIG. 7, when transition to the target orientation holding mode is performed, the display D notifies the vessel user of the transition to the target orientation holding mode by a predetermined display.

As a specific example, when transition to the target orientation holding mode is performed, the display D displays characters "target orientation holding mode" on the display screen. The display D may display a schematic aspect in which the marine vessel 100 and the target orientation TD are viewed in a plane in the target orientation holding mode. Broken lines inclined with respect to the target orientation TD displayed on the display D indicate a target orientation in a case in which the target orientation TD is adjusted.

The controller 5 shown in FIG. 1 performs a control to transition to the target course holding mode based on the transition operation of tilting the stick 40 (see FIG. 5) in a right-left direction.

Specifically, the controller 5 performs a control to transition to the target course holding mode based on the transition operation of tilting the stick 40 from the reference position P (see FIG. 5) to the right (or left) being performed.

The controller 5 performs a control to adjust the course set value indicating the position of the linear target course TC (see FIG. 8) based on the adjustment operation of tilting the stick 40 in the right-left direction being performed similarly to the transition operation to the target course holding mode after the transition to the target course holding mode.

Specifically, the controller 5 offsets the linear target course IC to the starboard side by a predetermined distance based on the adjustment operation of tilting the stick 40 from the reference position P to the right being performed after the transition to the target course holding mode. Furthermore, the controller 5 offsets the linear target course TC to the port side by a predetermined distance based on the adjustment operation of tilting the stick 40 from the reference position P to the left being performed after the transition to the target course holding mode.

At this time, as an example, the controller 5 may increase the amount of offset of the target course IC to the starboard side (port side) in a stepwise manner by repeating the adjustment operation of tilting the stick 40 from the reference position P to the right (left).

In the target course holding mode, a direction in which the target course TC is heading is able to be changed as in the target orientation holding mode. That is, the controller 5 performs a control to change the direction in which the target course TC is heading to the starboard side based on the adjustment operation of twisting the stick 40 in the clockwise direction from the reference position P being performed after the transition to the target course holding mode. Furthermore, the controller 5 performs a control to change the direction in which the target course TC is heading to the port side based on the adjustment operation of twisting the stick 40 in the counterclockwise direction from the reference position P being performed after the transition to the target course holding mode.

Figure 8:
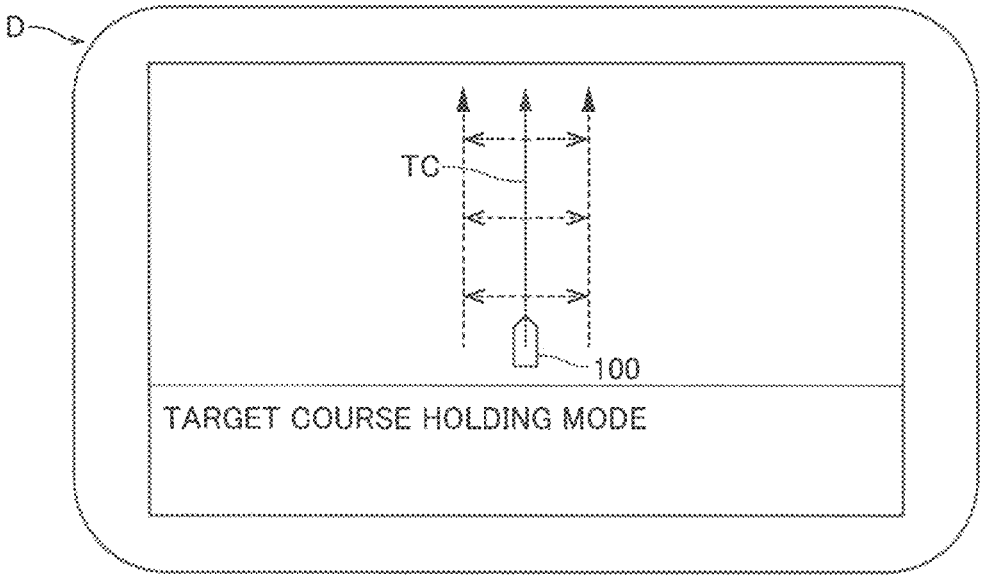
FIG. 8 is a diagram showing a display in a target course holding mode according to a preferred embodiment of the present invention.

As shown in FIG. 8, when transition to the target course holding mode is performed, the display D notifies the vessel user of the transition to the target course holding mode by a predetermined display.

As a specific example, when transition to the target course holding mode is performed, the display D displays characters "target course holding mode" on the display screen. The display D may display a schematic aspect in which the marine vessel 100 and the target course IC are viewed in a plane in the target course holding mode. Broken lines parallel to the target course TC displayed on the display D indicate a target course in a case in which the target course TC is offset.

Figure 9:
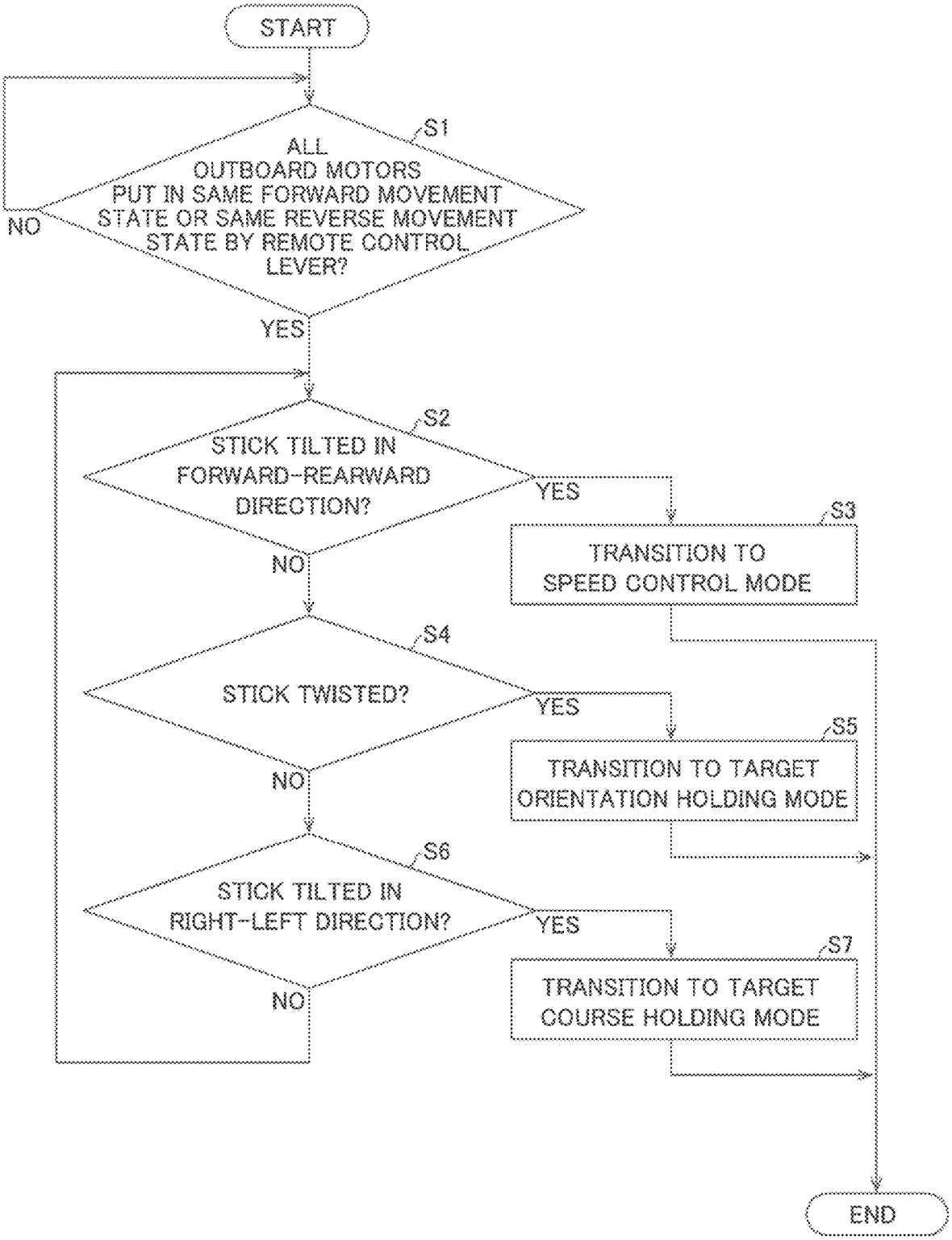
FIG. 9 is a flow diagram illustrating a transition control to an automatic marine vessel maneuvering mode according to a preferred embodiment of the present invention.

A transition control to the automatic marine vessel maneuvering mode (the speed control mode, the target orientation holding mode, or the target course holding mode) executed by the controller 5 is now described with reference to FIG. 9.

In step S1, it is determined whether all the outboard motors 100*b* are in the same forward movement state or in the same reverse movement state. That is, it is determined whether the levers 3*a* and 3*b* are located at the forward movement position FP or at the reverse movement position RP. When it is determined that all the outboard motors 100*b* are in the same forward movement state or in the same reverse movement state, the process advances to step S2, and when it is determined that all the outboard motors 100*b* are not in the same forward movement state or in the same reverse movement state, the process operation in step S1 is repeated.

Then, in step S2, it is determined whether or not the stick 40 has been tilted in the forward-rearward direction. When it is determined that the stick 40 has been tilted in the forward-rearward direction, the process advances to step S3, and when it is determined that the stick 40 has not been tilted in the forward-rearward direction, the process advances to step S4.

Then, in step S3, a control is performed to transition the normal marine vessel maneuvering mode to the speed control mode. With the above steps, the transition control is completed.

Then, in step S4, it is determined whether or not the stick 40 has been twisted. When it is determined that the stick 40 has been twisted, the process advances to step S5, and when it is determined that the stick 40 has not been twisted in the forward-rearward direction, the process advances to step S6.

Then, in step S5, a control is performed to transition the normal marine vessel maneuvering mode to the target orientation holding mode. With the above steps, the transition control is completed.

Then, in step S6, it is determined whether or not the stick 40 has been tilted in the right-left direction. When it is determined that the stick 40 has been tilted in the right-left direction, the process advances to step S7, and when it is determined that the stick 40 has not been tilted in the forward-rearward direction, the process returns to step S2.

Then, in step S7, a control is performed to transition the normal marine vessel maneuvering mode to the target course holding mode. With the above steps, the transition control is completed.

According to the various preferred embodiments of the present invention described above, the following advantageous effects are achieved.

According to a preferred embodiment of the present invention, the marine vessel maneuvering system 100*c* includes the operator (joystick 4) to receive both the propulsive force operation and the steering operation from the vessel user, and the controller 5 configured or programmed to perform a control to automatically drive the outboard motors 100*b* to move the marine vessel 100 in the automatic marine vessel maneuvering mode, and the controller 5 is configured or programmed to perform a control to transition to the automatic marine vessel maneuvering mode based on the transition operation being performed on the operator. Accordingly, the transition operation is performed on the operator that allows the propulsive force operation and the steering operation to be performed. That is, the propulsive force operation, the steering operation, and the transition operation are performed through the common device (operator). Therefore, when the transition operation is to be performed while the operator is operated, the vessel user does not need to stretch his or her hand to an operation panel unlike in the conventional case. Furthermore, the transition operation is performed on the operator itself, and thus the need to perform the transition operation on a DOWN button to set the rotation speed is eliminated unlike in the conventional case. Consequently, a decrease in the ease of (operability for) the transition operation to the automatic marine vessel maneuvering mode is significantly reduced or prevented. Thus, the operability for the transition operation to the automatic marine vessel maneuvering mode is improved.

According to a preferred embodiment of the present invention, the controller 5 is configured or programmed to discriminate between the automatic marine vessel maneuvering mode and the operator mode (joystick mode) in which the operator (joystick 4) receives the propulsive force operation and the steering operation from the vessel user, and perform a control to transition to the automatic marine vessel maneuvering mode with the operator mode being canceled. Accordingly, transition to the automatic marine vessel maneuvering mode is performed after the operator mode is reliably canceled.

According to a preferred embodiment of the present invention, the marine vessel maneuvering system 100*c* further includes the remote control lever 3 to switch the neutral states, the forward movement states, and the reverse movement states of the outboard motors 100*b*, and the controller 5 is configured or programmed to perform a control to transition to the automatic marine vessel maneuvering mode based on the operator mode (joystick mode) being canceled and all the outboard motors 100*b* operated by the remote control lever 3 being switched to the same forward movement state or the same reverse movement state. Accordingly, transition to the automatic marine vessel maneuvering mode is performed after the operator mode is reliably canceled and all the outboard motors 100*b* operated by the remote control lever 3 are reliably switched to the same forward movement state or the same reverse movement state.

According to a preferred embodiment of the present invention, the operator includes the joystick 4 including the stick 40 gripped and operated by the vessel user and the stick support 41 to support the stick 40, and the controller 5 is configured or programmed to perform a control to transition to the automatic marine vessel maneuvering mode based on the transition operation including at least one of tilting the stick 40 or twisting the stick 40 being performed. Accordingly, the transition operation on the joystick 4 is performed by at least one of tilting the stick 40 or twisting the stick 40, and thus the transition operation is intuitively performed. Thus, the operability for the transition operation to the automatic marine vessel maneuvering mode is further improved.

According to a preferred embodiment of the present invention, the automatic marine vessel maneuvering mode includes at least one of the speed control mode to adjust the rotation speeds of the engines 10 of the outboard motors 100*b* or the speed of the marine vessel 100, the target orientation holding mode to hold the target orientation TD of the marine vessel 100, or the target course holding mode to hold the linear target course TC of the marine vessel 100. Accordingly, the operability for the transition operation to at least one of the speed control mode, the target orientation holding mode, or the target course holding mode is improved.

According to a preferred embodiment of the present invention, the operator includes the joystick 4 including the stick 40 and the stick support 41, and the controller 5 is configured or programmed to perform a control to transition to the speed control mode based on the transition operation of tilting the stick 40 in the forward-rearward direction being performed when the automatic marine vessel maneuvering mode includes the speed control mode. Accordingly, the transition operation to the speed control mode is performed by tilting the stick 40 in the forward-rearward direction in which the marine vessel 100 moves, and thus the transition operation is intuitively performed. Thus, the operability for the transition operation to the speed control mode is further improved.

According to a preferred embodiment of the present invention, the controller 5 is configured or programmed to perform a control to adjust the speed set value indicating the rotation speed of the engine 10 or the speed of the marine vessel 100 based on the adjustment operation of tilting the stick 40 in the forward-rearward direction being performed similarly to the transition operation after the transition to the speed control mode. Accordingly, the transition operation to the speed control mode and the adjustment operation in the speed control mode are performed by a similar operation method. That is, after the transition operation to the speed control mode, the adjustment operation in the speed control mode is subsequently performed by a similar operation. Consequently, the vessel user easily obtains an operation method for the adjustment operation, and thus the operability for the transition operation to the speed control mode is still further improved.

According to a preferred embodiment of the present invention, the controller 5 is configured or programmed to, after the transition to the speed control mode, perform a control to increase the speed set value based on the adjustment operation of tilting the stick 40 forward being performed, and perform a control to decrease the speed set value based on the adjustment operation of tilting the stick 40 rearward being performed. Accordingly, the vessel user tilts the stick 40 forward according to the vessel user's feeling of wanting to move forward faster such that the controller 5 increases the speed set value. Furthermore, the vessel user tilts the stick 40 rearward according to the vessel user's feeling of wanting to move forward slower such that the controller 5 decreases the speed set value. Therefore, the adjustment operation is more intuitively performed. Thus, the operability for the transition operation to the speed control mode is still further improved.

According to a preferred embodiment of the present invention, the operator includes the joystick 4 including the stick 40 and the stick support 41, and the controller 5 is configured or programmed to perform a control to transition to the target orientation holding mode based on the transition operation of twisting the stick 40 being performed when the automatic marine vessel maneuvering mode includes the target orientation holding mode. Accordingly, the transition operation to the target orientation holding mode is performed by twisting (rotating) the stick 40 in a rotation direction in which the marine vessel 100 is steered. Therefore, the operability for the transition operation to the target orientation holding mode is further improved.

According to a preferred embodiment of the present invention, the controller 5 is configured or programmed to adjust the orientation set value indicating the target orientation based on the adjustment operation of twisting the stick 40 being performed similarly to the transition operation after the transition to the target orientation holding mode. Accordingly, the transition operation to the target orientation holding mode and the adjustment operation in the target orientation holding mode are performed by a similar operation method. That is, after the transition operation to the target orientation holding mode, the adjustment operation in the target orientation holding mode is subsequently performed by a similar operation. Consequently, the vessel user easily obtains an operation method for the adjustment operation, and thus the operability for the transition operation to the target orientation holding mode is still further improved.

According to a preferred embodiment of the present invention, the operator includes the joystick 4 including the stick 40 and the stick support 41, and the controller 5 is configured or programmed to perform a control to transition to the target course holding mode based on the transition operation of tilting the stick 40 in the right-left direction being performed when the automatic marine vessel maneuvering mode includes the target course holding mode. Accordingly, the transition operation to the target course holding mode is performed by a simple operation of tilting the stick 40 in the right-left direction, and thus the operability for the transition operation to the target course holding mode is further improved.

According to a preferred embodiment of the present invention, the controller 5 is configured or programmed to perform a control to adjust the course set value indicating the position of the linear target course based on the adjustment operation of tilting the stick 40 in the right-left direction being performed similarly to the transition operation after the transition to the target course holding mode. Accordingly, the transition operation to the target course holding mode and the adjustment operation in the target course holding mode are performed by a similar operation method. That is, after the transition operation to the target course holding mode, the adjustment operation in the target course holding mode is subsequently performed by a similar operation. Consequently, the vessel user easily obtains an operation method for the adjustment operation, and thus the operability for the transition operation to the target course holding mode is still further improved.

According to a preferred embodiment of the present invention, the controller 5 is configured or programmed to perform a control to cancel the operator mode (joystick mode) based on all the outboard motors 100*b* operated by the remote control lever 3 being switched from the neutral state to the same forward movement state or the same reverse movement state. Accordingly, the operator mode is canceled based on all the outboard motors 100*b* operated by the remote control lever 3 being switched from the neutral state to the same forward movement state or the same reverse movement state before the transition operation to the automatic marine vessel maneuvering mode is performed. Therefore, a shift switching operation also functions as an operation to cancel the operator mode, and thus operability in the preparatory stages before the transition operation is improved.

According to a preferred embodiment of the present invention, the marine vessel maneuvering system 100*c* further includes the display D to notify the vessel user of the transition to the automatic marine vessel maneuvering mode. Accordingly, the vessel user reliably recognizes that the transition to the automatic marine vessel maneuvering mode has been performed by the transition operation through the display D.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while the outboard motors including the engines are preferably propulsion devices attached to the hull in preferred embodiments described above, the present invention is not restricted to this. In the present invention, electric propulsion devices including electric motors may alternatively be propulsion devices attached to the hull.

While the transition operation to three of the speed control mode, the target orientation holding mode, and the target course holding mode is preferably performed by the joystick in preferred embodiments described above, the present invention is not restricted to this. In the present invention, the transition operation to any one or two of the speed control mode, the target orientation holding mode, and the target course holding mode may alternatively be performed.

While the automatic marine vessel maneuvering mode preferably includes the speed control mode, the target orientation holding mode, and the target course holding mode in preferred embodiments described above, the present invention is not restricted to this. In the present invention, the automatic marine vessel maneuvering mode may alternatively include various modes such as a track point mode to move the marine vessel such that the marine vessel passes through a predetermined point, a movement mode to move the marine vessel in a zigzag shape (spiral shape), and a set point mode to hold the position of the marine vessel.

While the controller preferably performs a control to adjust the rotation speed of the engine in the speed control mode in preferred embodiments described above, the present invention is not restricted to this. In the present invention, the controller may alternatively perform a control to adjust the speed of the marine vessel in the speed control mode.

While the transition operation to the automatic marine vessel maneuvering mode is preferably performed on the joystick in preferred embodiments described above, the present invention is not restricted to this. In the present invention, the transition operation to the automatic marine vessel maneuvering mode may alternatively be performed on the remote control lever and an attached operation panel, for example, in addition to the joystick.

While the transition operation to transition to the speed control mode is preferably an operation of tilting the stick of the joystick in the forward-rearward direction in preferred embodiments described above, the present invention is not restricted to this. In the present invention, the transition operation to transition to the speed control mode may alternatively be an operation of tilting the stick of the joystick in the right-left direction or an operation of twisting the stick of the joystick, for example. In such a case, it is necessary to prevent the transition operation to transition to the speed control mode and the transition operation to transition to another mode from overlapping each other.

While the transition operation to transition to the target orientation holding mode is preferably an operation of twisting the stick of the joystick in preferred embodiments described above, the present invention is not restricted to this. In the present invention, the transition operation to transition to the target orientation holding mode may alternatively be an operation of tilting the stick of the joystick in the right-left direction or an operation of tilting the stick of the joystick in the forward-rearward direction, for example. In such a case, it is necessary to prevent the transition operation to transition to the target orientation holding mode and the transition operation to transition to another mode from overlapping each other.

While the transition operation to transition to the target course holding mode is preferably an operation of tilting the stick of the joystick in the right-left direction in preferred embodiments described above, the present invention is not restricted to this. In the present invention, the transition operation to transition to the target course holding mode may alternatively be an operation of tilting the stick of the joystick in the forward-rearward direction or an operation of twisting the stick of the joystick, for example. In such a case, it is necessary to prevent the transition operation to transition to the target course holding mode and the transition operation to transition to another mode from overlapping each other.

While one transition operation on the joystick is preferably performed by one tilting operation or one twisting operation such as an operation of tilting the joystick forward, an operation of tilting the joystick rearward, an operation of tilting the joystick leftward, an operation of tilting the joystick rightward, an operation of twisting the joystick clockwise, or an operation of twisting the joystick counterclockwise in preferred embodiments described above, the present invention is not restricted to this. In the present invention, one transition operation on the joystick may alternatively be performed by a series of operations such as an operation of repeatedly tilting the joystick in the forward-rearward direction a predetermined number of times or an operation of repeatedly tilting the joystick in the right-left direction a predetermined number of times.

While the notifier preferably includes the display in preferred embodiments described above, the present invention is not restricted to this. In the present invention, the notifier may alternatively include a sound generator to emit a voice to notify the vessel user of the transition to the automatic marine vessel maneuvering mode, for example.

While the two outboard motors are preferably attached to the hull in preferred embodiments described above, the present invention is not restricted to this. In the present invention, one or three or more outboard motors may alternatively be attached to the hull.

While the process operations performed by the controller are described using a flowchart in a flow-driven manner in which processes are performed in order along a process flow for the convenience of illustration in preferred embodiments described above, the present invention is not restricted to this. In the present invention, the process operations performed by the controller may alternatively be performed in an event-driven manner in which the processes are performed on an event basis. In this case, the process operations performed by the controller may be performed in a complete event-driven manner or in a combination of an event-driven manner and a flow-driven manner.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine vessel maneuvering system comprising:

an operator to receive from a vessel user both a propulsive force operation to change a propulsive force of a propulsion device and a steering operation to turn the propulsion device to steer a marine vessel; and a controller configured or programmed to:

perform a control to automatically drive the propulsion device to move the marine vessel in an automatic marine vessel maneuvering mode; and perform a control to transition to the automatic marine vessel maneuvering mode based on a transition operation including at least one of tilting the operator or twisting the operator being performed.

2. The marine vessel maneuvering system according to claim 1, wherein the controller is configured or programmed to:

discriminate between the automatic marine vessel maneuvering mode and an operator mode in which the operator receives the propulsive force operation and the steering operation from the vessel user; and perform a control to transition to the automatic marine vessel maneuvering mode with the operator mode being canceled.

3. The marine vessel maneuvering system according to claim 2, further comprising:

a remote control lever to switch a neutral state, a forward movement state, and a reverse movement state of the propulsion device; wherein the propulsion device includes a plurality of propulsion devices; and the controller is configured or programmed to perform a control to transition to the automatic marine vessel maneuvering mode based on the operator mode being canceled and the plurality of propulsion devices operated by the remote control lever being switched to the same forward movement state or the same reverse movement state.

4. The marine vessel maneuvering system according to claim 1, wherein the operator includes a joystick including a stick gripped and operated by the vessel user and a stick support to support the stick; and the controller is configured or programmed to perform the control to transition to the automatic marine vessel maneuvering mode based on the transition operation including at least one of tilting the stick or twisting the stick being performed.

5. The marine vessel maneuvering system according to claim 1, wherein the automatic marine vessel maneuvering mode includes at least one of:

a speed control mode to adjust a rotation speed of a drive of the propulsion device or a speed of the marine vessel;

a target orientation holding mode to hold a target orientation of the marine vessel; or a target course holding mode to hold a linear target course of the marine vessel.

6. The marine vessel maneuvering system according to claim 5, wherein the operator includes a joystick including a stick and a stick support; and the controller is configured or programmed to perform a control to transition to the speed control mode based on the transition operation of tilting the stick in a forward-rearward direction being performed when the automatic marine vessel maneuvering mode includes the speed control mode.

7. The marine vessel maneuvering system according to claim 6, wherein the controller is configured or programmed to perform a control to adjust a speed set value indicating the rotation speed of the drive or the speed of the marine vessel based on an adjustment operation of tilting the stick in the forward-rearward direction being performed after the transition to the speed control mode.

8. The marine vessel maneuvering system according to claim 7, wherein the controller is configured or programmed to, after the transition to the speed control mode, perform a control to increase the speed set value based on the adjustment operation of tilting the stick forward being performed, and perform a control to decrease the speed set value based on the adjustment operation of tilting the stick rearward being performed.

9. The marine vessel maneuvering system according to claim 5, wherein the operator includes a joystick including a stick and a stick support; and the controller is configured or programmed to perform a control to transition to the target orientation holding mode based on the transition operation of twisting the stick being performed when the automatic marine vessel maneuvering mode includes the target orientation holding mode.

10. The marine vessel maneuvering system according to claim 9, wherein the controller is configured or programmed to perform a control to adjust an orientation set value indicating the target orientation based on an adjustment operation of twisting the stick being performed after the transition to the target orientation holding mode.

11. The marine vessel maneuvering system according to claim 5, wherein the operator includes a joystick including a stick and a stick support; and the controller is configured or programmed to perform a control to transition to the target course holding mode based on the transition operation of tilting the stick in a right-left direction being performed when the automatic marine vessel maneuvering mode includes the target course holding mode.

12. The marine vessel maneuvering system according to claim 11, wherein the controller is configured or programmed to perform a control to adjust a course set value indicating a position of the linear target course based on an adjustment operation of tilting the stick in the right-left direction being performed after the transition to the target course holding mode.

13. The marine vessel maneuvering system according to claim 3, wherein the controller is configured or programmed to perform a control to cancel the operator mode based on the plurality of propulsion devices operated by the remote control lever being switched from the neutral state to the same forward movement state or the same reverse movement state.

14. The marine vessel maneuvering system according to claim 1, further comprising:

a notifier to notify the vessel user of the transition to the automatic marine vessel maneuvering mode.

15. A marine vessel comprising:

a hull;

a propulsion device attached to the hull; and a marine vessel maneuvering system including:

an operator to receive from a vessel user both a propulsive force operation to change a propulsive force of the propulsion device and a steering operation to turn the propulsion device to steer the hull; and a controller configured or programmed to:

perform a control to automatically drive the propulsion device to move the hull in an automatic marine vessel maneuvering mode; and perform a control to transition to the automatic marine vessel maneuvering mode based on a transition operation including at least one of tilting the operator or twisting the operator being performed.

16. The marine vessel according to claim 15, wherein the controller is configured or programmed to:

discriminate between the automatic marine vessel maneuvering mode and an operator mode in which the operator receives the propulsive force operation and the steering operation from the vessel user; and perform a control to transition to the automatic marine vessel maneuvering mode with the operator mode being canceled.

17. The marine vessel according to claim 16, wherein the marine vessel maneuvering system further includes a remote control lever to switch a neutral state, a forward movement state, and a reverse movement state of the propulsion device;

the propulsion device includes a plurality of propulsion devices; and the controller is configured or programmed to perform a control to transition to the automatic marine vessel maneuvering mode based on the operator mode being canceled and the plurality of propulsion devices operated by the remote control lever being switched to the same forward movement state or the same reverse movement state.

18. The marine vessel according to claim 15, wherein the operator includes a joystick including a stick gripped and operated by the vessel user and a stick support to support the stick; and the controller is configured or programmed to perform the control to transition to the automatic marine vessel maneuvering mode based on the transition operation including at least one of tilting the stick or twisting the stick being performed.

19. The marine vessel according to claim 15, wherein the automatic marine vessel maneuvering mode includes at least one of:

a speed control mode to adjust a rotation speed of a drive of the propulsion device or a speed of the hull;

a target orientation holding mode to hold a target orientation of the hull; or a target course holding mode to hold a linear target course of the hull.

20. The marine vessel according to claim 19, wherein the operator includes a joystick including a stick and a stick support; and the controller is configured or programmed to perform a control to transition to the speed control mode based on the transition operation of tilting the stick in a forward-rearward direction being performed when the automatic marine vessel maneuvering mode includes the speed control mode.

* * * * *